US009713775B2

(12) United States Patent
Cogliandro

(10) Patent No.: US 9,713,775 B2
(45) Date of Patent: Jul. 25, 2017

(54) BALLOON GUN AND METHOD

(71) Applicant: Daniel Cogliandro, Dedham, MA (US)

(72) Inventor: Daniel Cogliandro, Dedham, MA (US)

(73) Assignee: Intelligent Innovation LLC, Dedham, MA (US)

( * ) Notice: Subject to any disclaimer, the term of this patent is extended or adjusted under 35 U.S.C. 154(b) by 164 days.

(21) Appl. No.: 14/537,930

(22) Filed: Nov. 11, 2014

(65) Prior Publication Data

US 2016/0129359 A1 May 12, 2016

(51) Int. Cl.

| | |
|---|---|
| ***A63H 3/06*** | (2006.01) |
| ***A63H 33/00*** | (2006.01) |
| ***A63H 27/10*** | (2006.01) |
| ***A63H 5/04*** | (2006.01) |

(52) U.S. Cl.

CPC ..... *A63H 33/00* (2013.01); *A63H 5/04* (2013.01); *A63H 27/10* (2013.01); *A63H 33/009* (2013.01); *A63H 2027/1008* (2013.01); *A63H 2027/1033* (2013.01); *A63H 2027/1041* (2013.01)

(58) Field of Classification Search

CPC ..... A63H 27/1041; A63H 27/1066; A63H 2027/1008; A63H 2027/1041; A63H 2027/1066; A63H 33/00; A63H 33/009; A63H 5/04; A63H 27/10

USPC ..... 446/186, 187, 212, 220, 225

See application file for complete search history.

(56) References Cited

U.S. PATENT DOCUMENTS 2,453,571 A * 11/1948 De Barbieri ..... A63H 27/002 446/31
2,549,668 A * 4/1951 Cox ..... A63H 7/04 446/289
2,600,883 A * 6/1952 King ..... F41B 7/00 124/16
2,684,776 A * 7/1954 Rosenstein ..... C09J 7/04 206/346
2,708,431 A * 5/1955 Walker ..... F41B 3/02 124/22
2,810,379 A * 10/1957 Solomon ..... A63H 37/00 124/16
3,025,634 A * 3/1962 Barricks ..... A63H 27/10 446/187
3,094,807 A * 6/1963 Dorman ..... A63H 27/10 24/543
3,166,321 A * 1/1965 Fleishman ..... A63B 65/122 124/27

(Continued)

*Primary Examiner* — Melba Bumgarner
*Assistant Examiner* — Joseph B Baldori

(57) ABSTRACT

A balloon gun comprising a hollow cylindrical body, one or more hand grips attached to the cylindrical body, a release trigger pivotally mounted on one of the hand grips or on the hollow cylindrical body and a balloon attaching mechanism. A balloon inflated with a fluid can be inserted inside the hollow cylindrical body and the inflated balloon is held by the balloon attaching mechanism. When the trigger is pressed the neck of the inflated balloon gets released from the balloon attaching mechanism and by the difference in fluid pressure that exists between the inside and outside of the balloon, the fluid rushes out of the balloon once the neck gets released from the balloon attaching mechanism and the force of the fluid coming out of the inflated balloon pushes the balloon forward and the balloon flies till the fluid pressures inside and outside of the balloon get equalized.

6 Claims, 8 Drawing Sheets

(56) References Cited

U.S. PATENT DOCUMENTS 3,405,941 A * 10/1968 Martell ..... A63F 9/0243 273/349
3,515,387 A * 6/1970 House ..... F41B 7/025 124/19
3,698,374 A * 10/1972 Casper ..... A63F 9/0252 124/41.1
3,769,955 A * 11/1973 Dugan ..... A63H 27/14 124/16
3,949,518 A * 4/1976 Lenza ..... A63H 27/14 124/16
4,134,228 A * 1/1979 Ortiz ..... A63H 27/14 124/31
4,149,338 A * 4/1979 Wolf ..... A63H 27/06 428/24
4,216,609 A * 8/1980 Ortiz ..... A63H 37/00 446/401
4,248,008 A * 2/1981 Pitkanen ..... A63H 27/10 446/187
4,380,103 A * 4/1983 McGrath ..... A44B 99/00 24/30.5 P
4,416,038 A * 11/1983 Morrone, III ..... A44B 99/00 24/487
4,735,239 A * 4/1988 Salmon ..... F41B 9/0078 141/114
5,031,299 A * 7/1991 Lovik ..... G09F 1/06 29/454
5,036,985 A * 8/1991 Lovik ..... A47F 7/00 211/13.1
5,312,286 A * 5/1994 Domen ..... A63H 27/06 446/187
5,579,749 A * 12/1996 Wilkinson ..... F41B 3/005 124/16
5,588,896 A * 12/1996 Goodman ..... A63H 27/10 124/57
5,666,709 A * 9/1997 Suzuki ..... A63H 27/10 29/235
5,885,129 A * 3/1999 Norris ..... A63H 5/04 446/405
5,979,424 A * 11/1999 Alvarez ..... F41B 7/08 124/16
6,050,874 A * 4/2000 Ries ..... A63H 27/10 446/220
7,249,991 B1 * 7/2007 Watson ..... A63H 27/10 24/30.5 S
7,275,496 B2 * 10/2007 French ..... G01W 1/08 116/210
7,331,337 B2 * 2/2008 Cuisinier ..... F41B 3/02 124/5
7,448,371 B2 * 11/2008 Sapir ..... F41B 3/005 124/16
7,464,701 B1 * 12/2008 Mendoza ..... F41B 7/08 124/20.1
7,648,102 B2 * 1/2010 French ..... G01W 1/08 244/31
8,074,838 B1 * 12/2011 Tate ..... F41B 9/00 222/429
8,257,134 B2 * 9/2012 Zuloff ..... A63F 5/04 124/37
8,297,268 B2 * 10/2012 Kenworthy ..... F41B 1/00 102/520
8,393,299 B1 * 3/2013 Bernat ..... A01K 15/025 119/702
8,893,696 B2 * 11/2014 Kenworthy ..... F42B 6/003 124/62
9,038,616 B2 * 5/2015 Phillips ..... A63H 33/00 124/61
9,120,551 B1 * 9/2015 Ratner ..... B64F 1/14
2004/0198146 A1 * 10/2004 Murray ..... A63H 27/10 446/220
2006/0081665 A1 * 4/2006 Nguyen ..... A45F 5/00 224/267
2008/0022990 A1 * 1/2008 Mitchell ..... F41B 11/641 124/65
2008/0166943 A1 * 7/2008 Hou ..... A63H 27/10 446/86
2016/0129359 A1 * 5/2016 Cogliandro ..... A63H 27/10 446/220

* cited by examiner

BALLOON GUN AND METHOD

FIELD OF THE INVENTION

The present invention generally relates to play toys for all people types and ages. More particularly, the present invention relates to a balloon gun which is safe and easy to use and is used for entertainment purposes.

BACKGROUND OF THE INVENTION

There are many needs for play guns of all types, however some shoot projectiles such metal or plastic BBs which can damage eyes and skin and vacuum cleaners. Nerf brand and similar foam bullet guns are also a favorite toy for children. However, they do not provide for the wonder and safety of a gun that shoots balloons that are clearly safe and will not harm household equipment or people.

Nerf™ brand guns and other spring or air propelled projectile guns can shoot a projectile such as rubber tipped foam bullet or foam disk into an eye which may blind the person. Recently Nerf brand guns have become powerful enough to hurt the skin. Airsoft™ brand guns shoot a hard plastic pellet and are very powerful and can easily blind or maim an individual or animal. Cap guns are known to cause burns and damage ears when used incorrectly. By contrast a balloon under its own power will typically either bounce off a person harmlessly, or run out of air and fall to the ground.

BB guns, Airsoft guns and Nerf guns all use ammunition that is difficult to find after fired, and can get lost in the grass or tall carpet, often damaging vacuum cleaners when picked up inadvertently. Contrarily, the balloons used in a balloon gun can be of bright colors and are larger and easier to see and recover and reuse in most situations.

OBJECTS OF THE INVENTION

It is an object of the present invention to provide a balloon gun that is a novel toy and is usable with a balloon for entertainment purposes.

Another object of the present invention is to provide a balloon gun and method that provides a barrel balloon gun.

A still further object of the present invention is to provide a balloon gun and method that allows the balloon to shoot out from the gun and fly in a trajectory which is roughly aligned with the barrel of the balloon gun.

A still another object of the present invention is to provide a balloon gun and method that allows a balloon to be pumped up outside of the balloon gun and be clipped to retain the inflation pressure by using removable, reusable or disposable clips.

A still further object of the present invention is to provide a balloon gun and method that provides for a non removable reusable clip permanently affixed to the trigger mechanism of the balloon gun and that can be attached to the inflated balloon for eventual release.

Yet another object of the present invention is to provide a balloon gun and method that facilitates insertion of a user's hand into the barrel of the balloon gun for attaching a balloon to the balloon attaching mechanism and for adjusting position of the balloon attaching mechanism for changing the trajectory of the propelled balloon.

A further object of the present invention is to provide a balloon gun and method that provides an optional holder for pre-inflated balloons, typically using a disposable or reusable clip to hold the inflated balloon from the underside of the gun or the user's belt to facilitate quick loading of inflated balloons to the gun in a gaming situation.

A still further object of the present invention is to provide a balloon gun and method that provides a rail barrel gun for balloons.

A still another object of the present invention to provide a balloon gun and method that provides a rail barrel gun with reduced cross section area towards the front end of the rail which provides guidance and trajectory for the balloon after release.

A still another object of the present invention is to provide a balloon gun and method that provides for accessories like a pump and quick seal clips for the balloons such that the balloons can be prepared prior to affixing the balloons into the gun.

Another object of the present invention is to provide a balloon gun and method that provides for removable reusable or disposable clips.

A further object of the present invention is to provide a balloon gun which is an entertaining toy and which is simple and economical of manufacture, durable in use, and effective in operation.

Details of the foregoing objects and of the invention, as well as additional objects, features and advantages of the invention will become apparent to those skilled in the art upon consideration of the following detailed description of the preferred embodiments exemplifying the best mode of carrying out the invention as presently perceived.

SUMMARY OF THE INVENTION

It should be appreciated that this Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

Accordingly, a balloon gun is presented. In accordance with one embodiment of the present invention, the balloon gun is a Barrel Balloon Gun. The Barrel Balloon Gun includes a cylindrical body which is hollow, a rear hand grip attached to the rear end of the cylindrical body, a trigger pivotally mounted by a pin on the cylindrical body or on the rear hand grip, a balloon attachment mechanism and a front hand grip attached to the forward of the cylindrical body. The main cylindrical body with front end and rear end has a hatch with hatch cover. A balloon inflated with a fluid is inserted inside the hollow cylindrical body through an opening of the front end and the inflated balloon is held by the balloon attaching mechanism. When the trigger is pressed the neck of the inflated balloon gets released from the balloon attaching mechanism and, due to the difference in fluid pressure, that exists between the inside and outside of the inflated balloon caused by the elasticity of the inflated balloon, said fluid rushes out of said inflated balloon and the force of the fluid coming out of the inflated balloon pushes the balloon forward. This makes the inflated balloon fly until the fluid pressures inside and outside of the inflated balloon become equalized.

In another embodiment of the balloon gun of the present invention, the balloon gun is a Rail Balloon Gun. The Rail Balloon Gun includes a rail barrel, a hand grip, a trigger, a linkage, a one directional valve and a balloon clasping mechanism. In a preferred embodiment, the rail barrel can be longitudinally varying in cross-section. In a preferred embodiment, the cross sectional area of the rail barrel varies from rear end to front end in multiple steps. The rail barrel has a longitudinal bore made with both ends open and a unidirectional valve installed in between.

The trigger is pivotally mounted on a pin and the linkage is also pivotally mounted on a pin. The trigger is connected to the linkage by means of pins. In a preferred embodiment, a clasping mechanism comprising two concentric semi circular pieces of clamps is mounted over the rail barrel. The clamp pieces sit tightly over the rail barrel due to spring tension.

The neck of a non-inflated balloon is pulled over the front end of the rail barrel and the neck of the balloon is held tightly by the balloon clasping mechanism. The non-inflated balloon is inflated by blowing a fluid through the longitudinal bore from the mouthpiece end and the unidirectional valve prevents the fluid from coming out of the balloon and the balloon becomes inflated. When the trigger is pulled the clamps are released and the fluid present inside the inflated balloon tries to come out rushing through the loosened neck, being stopped by the one way valve on one end, and the resulting force propels the inflated balloon out of the rail barrel of the rail balloon gun.

Other systems, apparatuses, and methods according to embodiments will be or become apparent to one with skill in the art upon review of the following drawings and Detailed Description. It is intended that all such additional systems, apparatuses, and/or methods be included within this description, be within the scope of the present disclosure, and be protected by the accompanying claims.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DETAILED DESCRIPTION OF THE INVENTION

Figure 1:
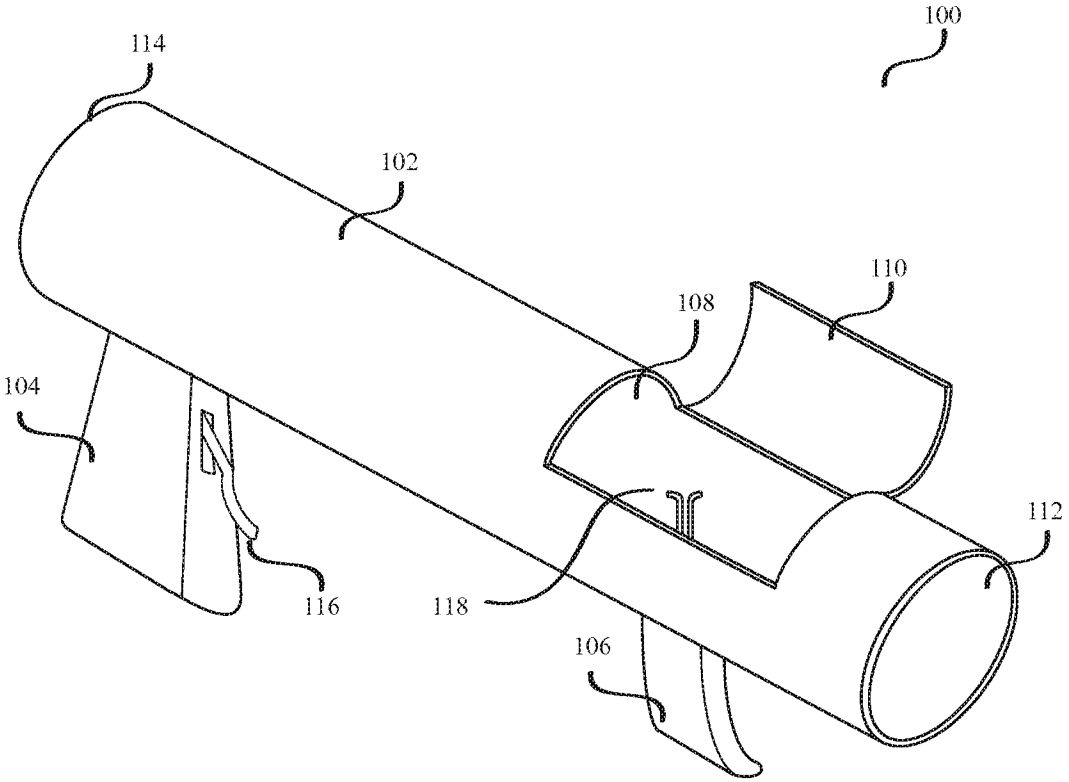
FIG. 1 illustrates an isometric view of a barrel balloon gun in accordance with an embodiment of the present invention.

Embodiments of the present invention will be described in detail below with reference to attached drawings. Reference should now be made to the drawings, in which the same reference numerals are used throughout the different drawings to designate the same or similar components. Further, the detailed description of well known functions and configurations that may obscure the gist of the present invention will be omitted.

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

FIG. 1 illustrates an isometric view of a balloon gun in accordance with an embodiment of the present invention. The balloon gun 100, in the present embodiment, will be referred to as Barrel Balloon Gun 100. The Barrel Balloon Gun 100 includes a cylindrical body 102 which is hollow, a rear hand grip 104 attached to the rear end of the cylindrical body 102, a trigger 116 pivotally mounted by a pin 126 (refer FIG. 2A) on the cylindrical body 102 or on the rear hand grip 104, a balloon attachment mechanism 118 and a front hand grip 106 attached to the forward of the cylindrical body 102. The main cylindrical body 102 with front end 112 and rear end 114 has a hatch 108 with hatch cover 110.

In some preferred embodiments, the front end 112 of cylindrical body 102 is made to accommodate interchangeable plurality of removable barrels of various sizes and shapes to affect various trajectories and behaviors of a balloon when launched. In some other embodiments, a single barrel can be made to affect various trajectories and behaviors of a balloon when launched.

Figure 2A:
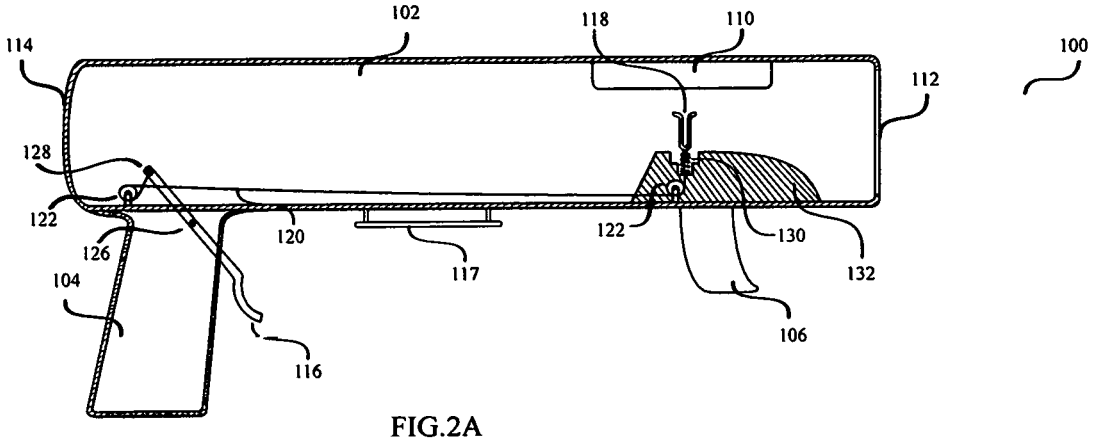
FIG. 2A illustrates a front sectional view of a barrel balloon gun in accordance with an embodiment of the present invention.

With reference to FIG. 2A, in one preferred embodiment of the Barrel Balloon Gun 100, one end of a cord 120 is attached to a pin 128, which is situated at the opposite end of the finger grip of the trigger 116, and the other end of the cord is attached to the bottom of the balloon attaching mechanism 118 which is permanently attached to the gun and is designed to seal the balloon by squeezing the balloon filler neck. The cord can be passed over one or more pulleys 122 in such a way that, when the trigger 116 is pulled back towards the rear hand grip 104 by pressing it with a finger, the cord 120 pulls the balloon attaching mechanism 118 downwards against the spring 130. The downward motion pushes the balloon neck up and off the clip 118 which releases the balloon which lifts off of the clip 118. In another preferred embodiment of the present invention, the force required to actuate the balloon attaching mechanism 118 is transmitted from the trigger 116 through a linkage (not shown in the figures) instead of the cord 120.

Figure 2B:
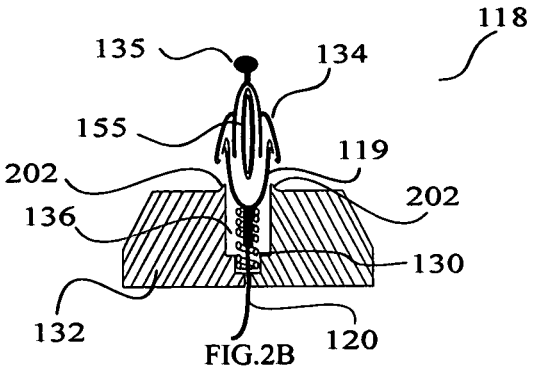
FIG. 2B illustrates an exemplary attaching arrangement for attaching a balloon to the barrel balloon gun in accordance with an embodiment of the present invention.

FIG. 2B shows another exemplary balloon attaching mechanism 118 for detachably attaching an inflated balloon to the Barrel Balloon Gun 100. In this embodiment, the balloon attaching mechanism 118 includes a lower clip 119, a upper clip 134 and a spring 130. The lower clip 119 is held affixed upright in the slot 136 made in the base 132, the base 132 being firmly mounted inside the cylindrical body 102.

The filler neck 155 of an inflated balloon can be closed and sealed by use of a upper clip 134 prior to mounting into the Barrel Balloon Gun 100. The upper clip 134 holding the neck 155 of the inflated balloon can then be detachably attached to the lower clip 119 by simply pressing into it. In a preferred embodiment, the portion of the upper clip 134 holding the balloon neck 155 goes inside the arms of the lower clip 119 (arms of the lower clip are also referred to herein alternatively as a plurality of lower clip arms). As the trigger 116 is pulled, the cord 120 pulls the lower clip 119 inside the slot 136 and, in doing so, the arms of the upper clip 134 (the arms of the upper clip which engage with the arms of the lower clip are also referred to herein alternatively as a plurality of upper clip arms) get pressed outward by the raised top edges 202 of the slot 136 unlocking the engagement between the upper clip 134 and lower clip 119. As the arms of the upper clip 134 tend to move apart due to the outward force exerted by the raised top edges 202 of the slot 136, the upper clip 134 gets dislodged from the engagement with the lower clip 119 and the balloon neck 155 also gets released. The detachable upper clip 134 can be of disposable type or of reusable type. In some embodiments the balloon attaching mechanism 118 comprises of a permanent clip.

Figure 7:
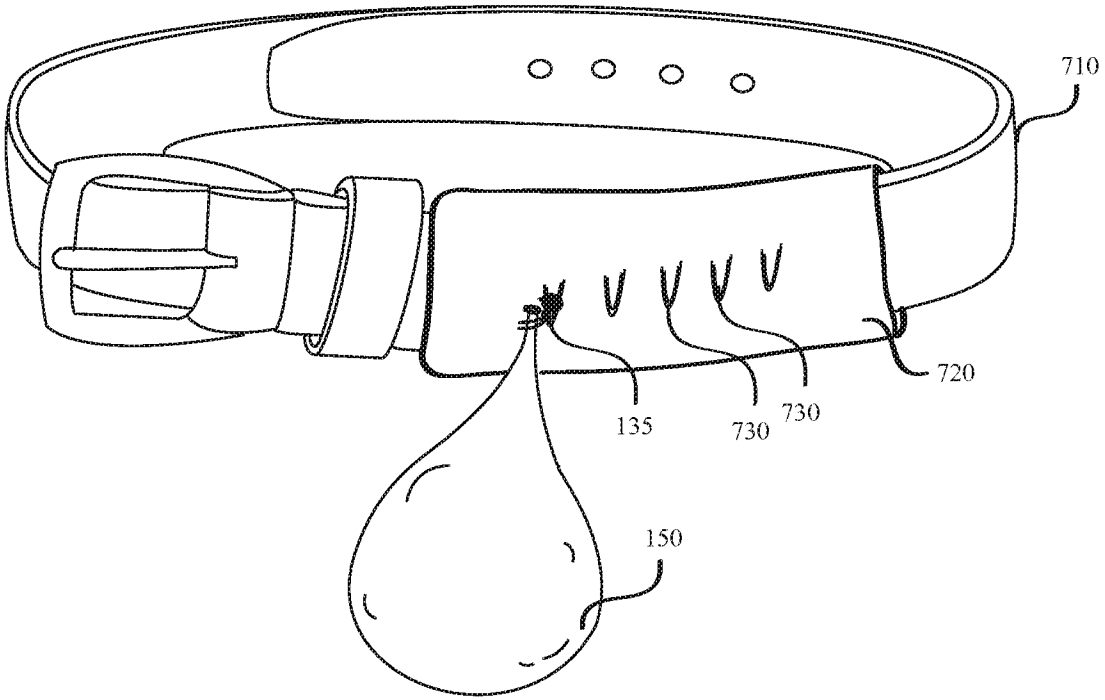
FIG. 7 illustrates a belt based inflated balloon holding arrangement in accordance with one embodiment of the present invention.
Figure 8:
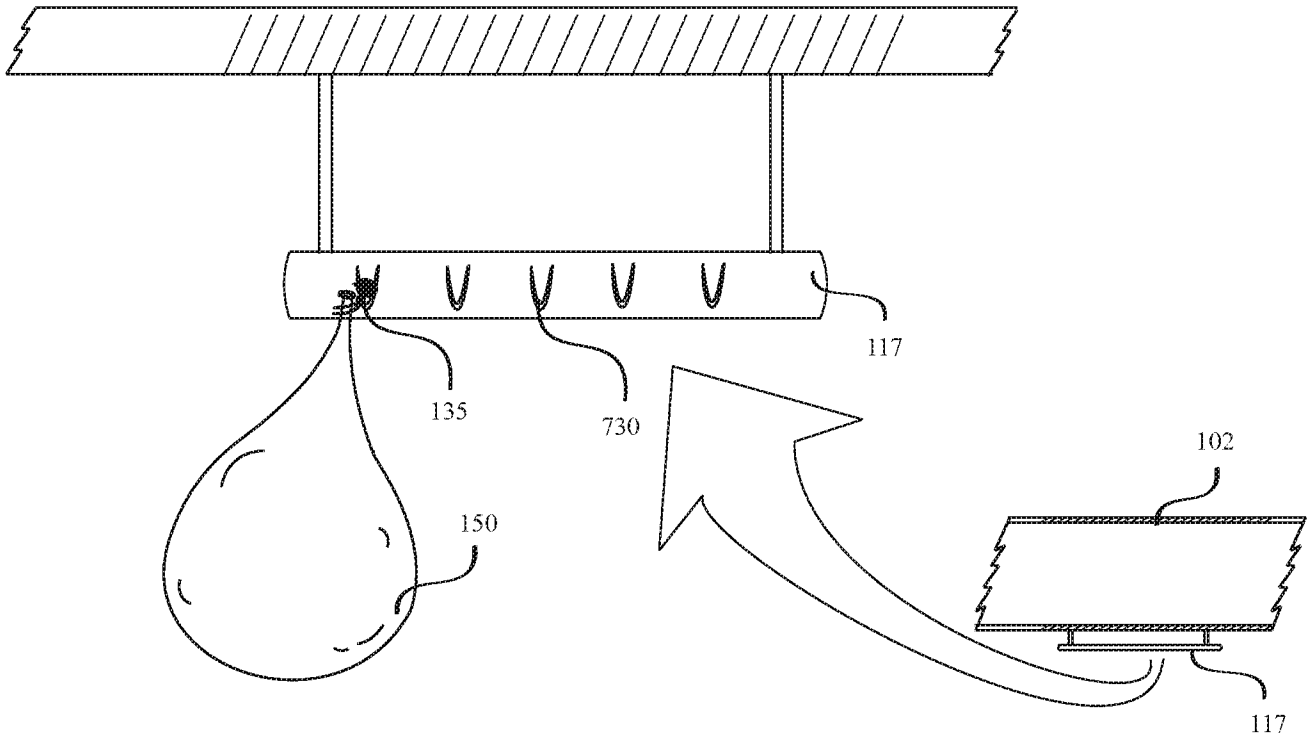
FIG. 8 illustrates an ammunition holder rail affixed to the barrel of a barrel balloon gun for holding inflated balloons in accordance with one embodiment of the present invention.

Inflated balloons, sealed individually with upper clip 134, can be kept ready for quick loading into the Barrel Balloon Gun 100 with the help of an ammunition holder. In some embodiments, the Barrel Balloon Gun 100 can have an ammunition holder rail 117 as shown in FIG. 2. As shown in FIG. 8, the ammunition holder rail 117 is provided with plurality of clip holders 730. By sliding the button end 135 of the upper clip 134 onto these clip holders 730 one or more inflated balloons 150 can be kept ready for use. In some other embodiments, as shown in FIG. 7, a belt based inflated balloon holding arrangement 720 is provided. This belt based inflated balloon holding arrangement 720 can be easily worn over a common waist belt 710. The belt based inflated balloon holding arrangement 720 includes a plurality of clip holders 730 similar to those included in the ammunition holder rail 117 for holding plurality of inflated balloons 150. Although, only two embodiments of the inflated balloon holding arrangement have been described herein, it would be obvious to those skilled in the art that, keeping the spirit of invention intact the balloon holding arrangement can take many other shape and size.

Figure 3:
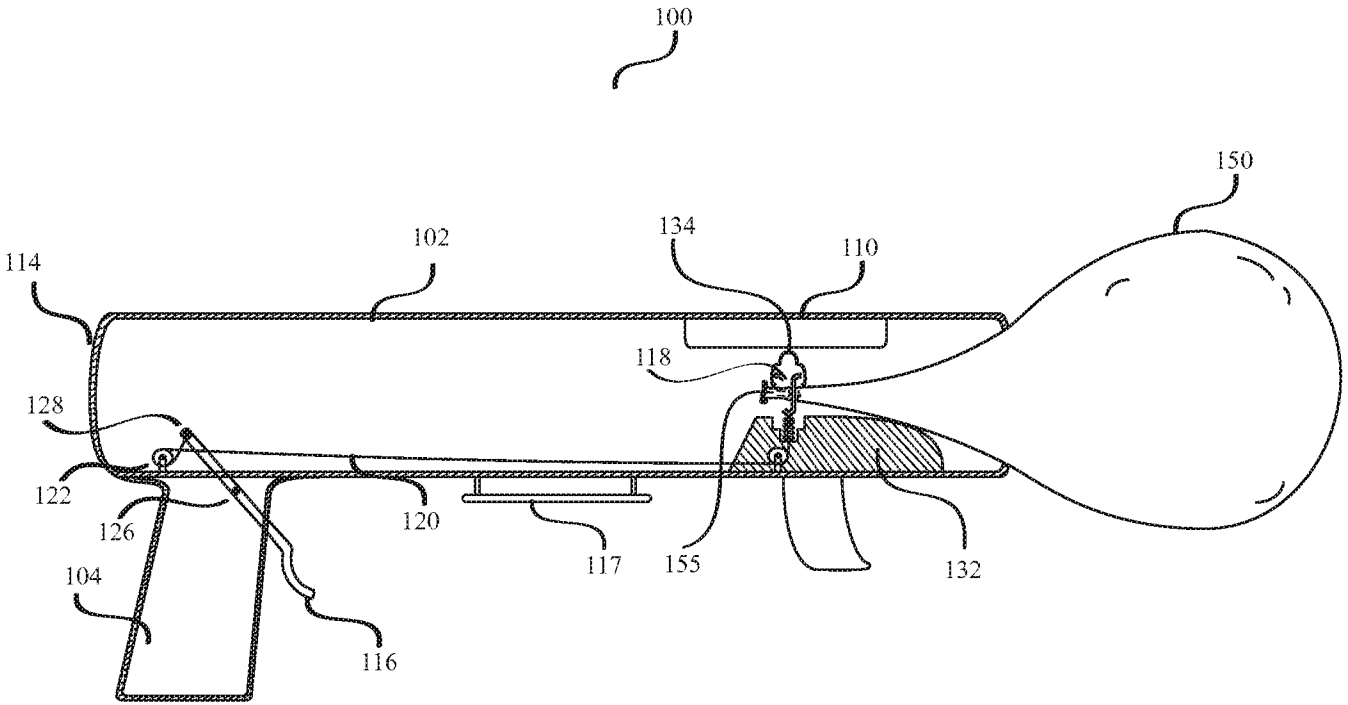
FIG. 3 illustrates a front sectional view of a barrel balloon gun with a balloon detachably attached in accordance with an embodiment of the present invention.
Figure 4:
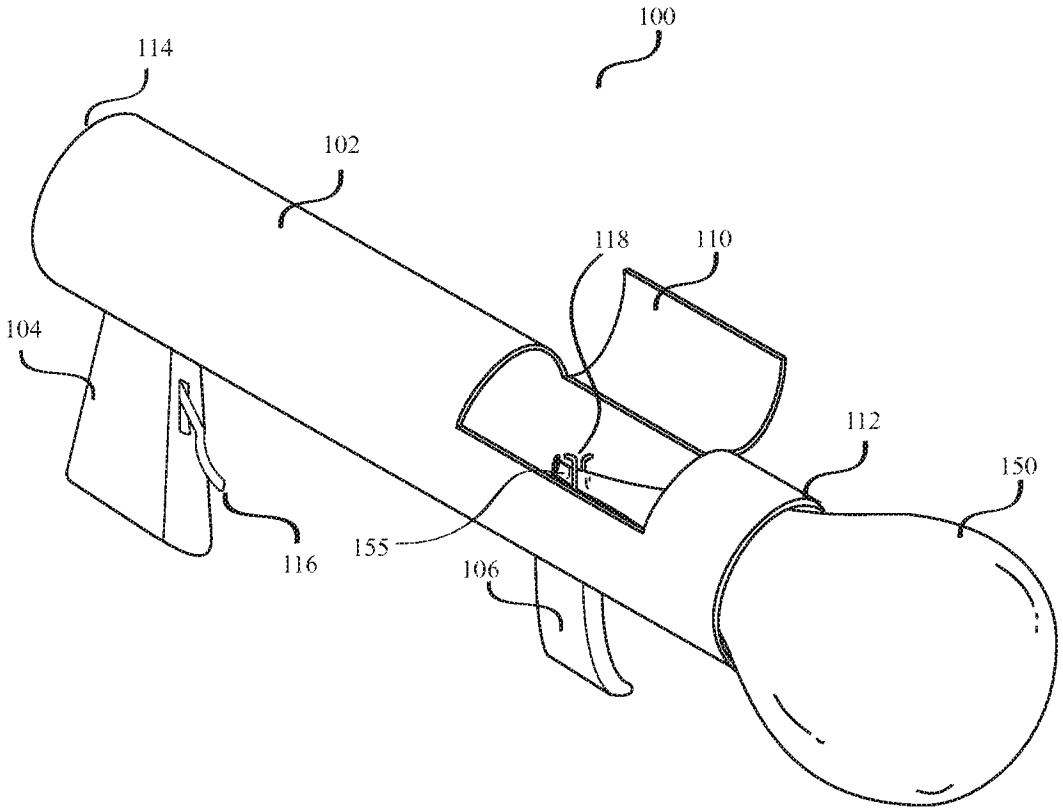
FIG. 4 illustrates an isometric view of a barrel balloon gun with a balloon detachably attached in accordance with an embodiment of the present invention.

FIG. 3 and FIG. 4 show Barrel Balloon Gun 100 with an inflated balloon 150 detachably attached between upper clip 134 and lower clip 119. For loading an inflated balloon in the Barrel Balloon Gun 100, the neck 155 of the inflated balloon is to be pinched between the fingers and the neck 155 is inserted between the arms of the lower clip 119. Thereafter, the upper clip 134 is pressed over to get the neck 155 of the balloon locked and sealed between both the clips. The size of the hatch 108 (refer FIG. 1) is made big enough so that a person can open the hatch cover 110 and access the inside of the cylindrical body 102 where the balloon is required to be attached. As the trigger 116 is pulled, the clips 119 and 134 get unlocked and the upper clip 134 pops out releasing the balloon 150 from the balloon attaching mechanism 118. The difference in fluid pressure that exists between the inside and outside of the balloon 150 due to elasticity of the inflated balloon makes the fluid rush out of the balloon 150 once the neck 155 gets released from the balloon attaching mechanism 118. The force of the fluid coming out of the balloon 150 would push the balloon forward and the balloon would fly till the fluid pressures inside and outside the balloon 150 get equalized.

In a preferred embodiment, the trajectory of the balloon 150 released from the Barrel Balloon Gun 100 of the present invention can be aligned, at least for some distance of the flight path, with the longitudinal axis of the cylindrical body 102. The more the distance the neck of a balloon traverse inside the cylindrical body 102 before leaving through the front end 112, the more is the possibility of the released balloon taking a straighter path aligned with the longitudinal axis of the balloon. Accordingly, in some preferred embodiments, the base 132 can be made to mount slidably on a rail (not shown in figures) inside the cylindrical body 102 so that a user can adjust the position of the base 132 to set the distance as per the preference of desired trajectory of the balloon released, which may also increase the forces of forward motion due to the elasticity of the balloon. In some preferred embodiments, the face of the base 132 towards the open end 112 of the cylindrical body 102 can be given such a shape which can facilitate launch of the balloon in a straighter or crooked path. The trajectory of the balloon becomes more unpredictable when it is released from a location near to the front end 112 of the cylindrical body 102. In some embodiments the inner surface of the cylindrical body, towards the front end 112 is made rifled with rifling designed to either affect a straight or curved trajectory, whereas, in some other embodiments, the inner surface is made smooth as per desired trajectory of the balloon propelling out of the Barrel Balloon Gun 100.

Figure 5A:
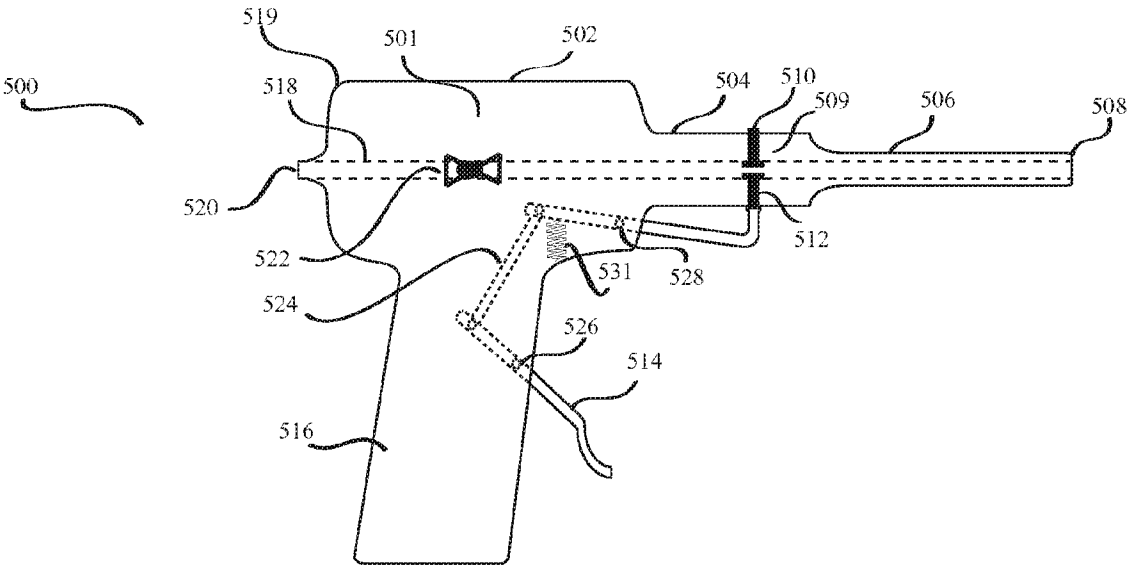
FIG. 5A illustrates front view of a rail balloon gun in accordance with another embodiment of the present invention.

FIG. 5A illustrates another embodiment of the balloon gun of the present invention. Hereinafter, this embodiment of the present invention would be referred to as Rail Balloon Gun 500. The Rail Balloon Gun 100, in the preferred embodiment as shown in FIG. 5A, includes a rail barrel 501, a hand grip 516, a trigger 514, a linkage 524, a one directional valve 522 and a balloon clasping mechanism 509. In a preferred embodiment, the rail barrel 501 can be longitudinally varying in cross-section. As shown in FIG. 5A, the cross sectional area of the rail barrel 501 varies from rear end 519 to front end 508 in three sections 502, 504 and 506 respectively. The rail barrel 501 has a longitudinal bore 518 made with both ends open and a unidirectional valve 522 installed in between.

In some preferred embodiments, the front end 508 of rail barrel 501 is made to accommodate interchangeable removable barrels of various sizes and shapes to affect various trajectories and behaviors of a balloon when launched. In some other embodiments, a single barrel can be made to affect various trajectories and behaviors of a balloon when launched.

Figure 5B:
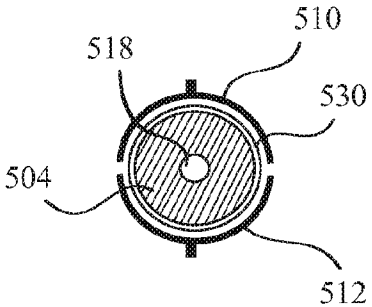
FIG. 5B illustrates an exemplary balloon clamping mechanism in accordance with another embodiment of the present invention.

The trigger 514 is pivotally mounted on pin 526 and the linkage is pivotally mounted on pin 528. The trigger 514 is connected to the linkage 524 by means of a pin. In a preferred embodiment, as shown in FIG. 5B, a clasping mechanism 509 comprising two concentric semi circular pieces of clamps 510 and 512 is mounted over the rail barrel section 504. The clamp pieces 510 and 512 sit tightly over the rail barrel 504 due to spring tension.

Figure 6:
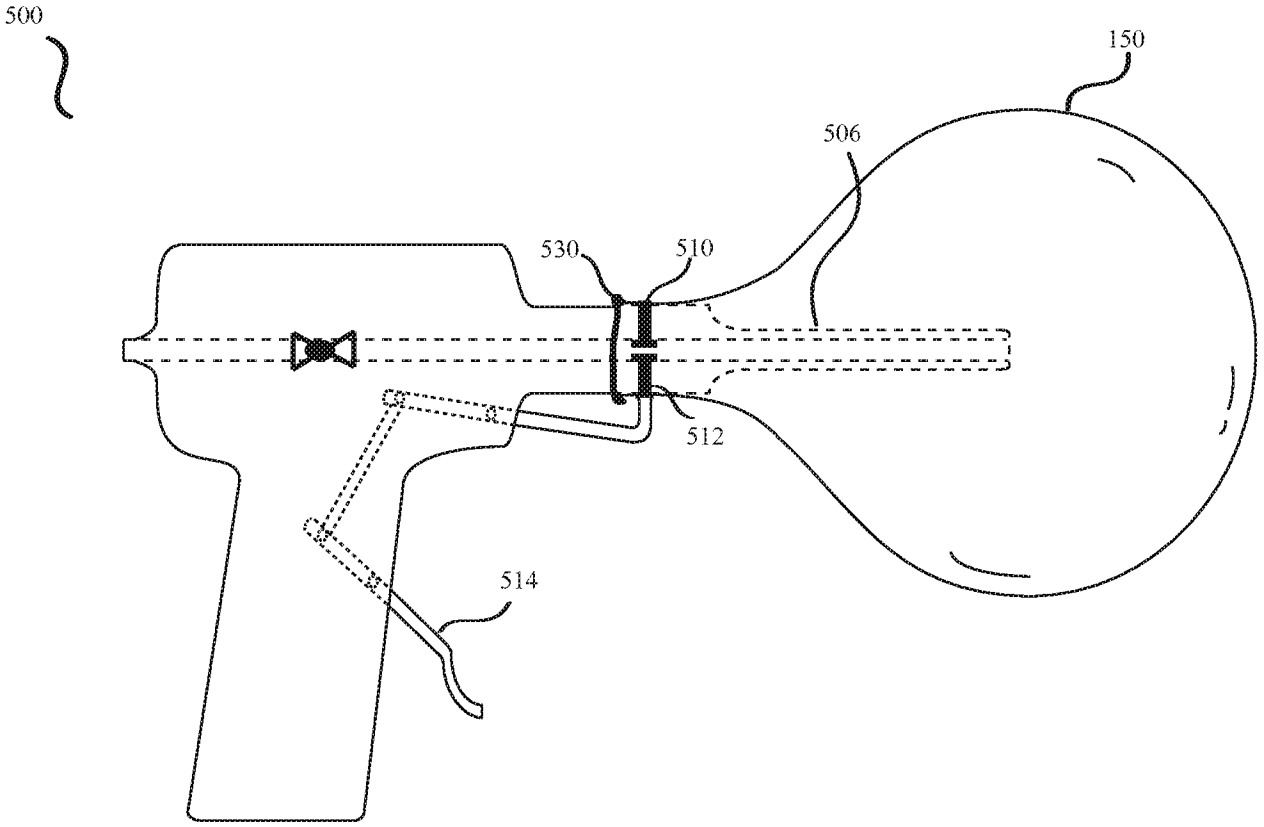
FIG. 6 illustrates front view of a rail balloon gun with a balloon attached in accordance with another embodiment of the present invention.

Reference to FIG. 5A, FIG. 5B and FIG. 6, to load a non-inflated balloon into the Rail Balloon Gun 500, the neck 530 of the balloon is to be pulled over the rail section 504 axially with the trigger 514 in pulled condition so that the neck 530 of the balloon can be taken through under the clamps 510 and 512. The trigger 514 is then released and the clamps 510 and 512 hold the neck 530 of the balloon 150 tightly over the rail section 504 due to spring tension. The balloon 150 can then be inflated by blowing any suitable fluid such as air, nitrogen, helium etc. through the longitudinal bore 518 from the mouthpiece end 520. The unidirectional valve 522 prevents the fluid from coming out of the balloon 150 and due to the tight sealing produced by the engaged clamp 510 and 512, the balloon 150 gets inflated. When the trigger 514 is pulled, the clamps 510 and 512 move outwardly and the fluid present inside the balloon 150 tries to come rushing out through the loosened neck 530. The resulting force propels the balloon 150 out of the rail of the rail balloon gun 500. The reduced rail cross sectional area 506 makes sure that the balloon faces least amount of resistance due to friction when the balloon 150 leaves the rail.

In another preferred embodiment, the one or more hand grips provided in the Balloon Gun of the present invention are not necessarily any extended or projected parts but a hand grip can be any portion of the main body of the Balloon Gun suitable for holding the Balloon Gun. For example, in case of the Barrel Balloon Gun 100, the hand grips 104 and 106 can be any portions of the cylindrical body 102 suitable for holding the Barrel Balloon Gun. Similarly, for Rail Balloon Gun 500, the hand grip 516 can be any portion of the rail barrel 501 suitable for holding the Rail Barrel Gun.

In a preferred embodiment of the present invention, a method of using the barrel balloon gun comprises the steps of opening the hatch cover of the hollow cylindrical body by a user, accessing the inside of the hollow cylindrical body by the user, detachably attaching the neck of an inflated balloon to a balloon clasping mechanism by the user, holding the balloon gun at the rear hand grip and the front hand grip by the user and pulling the trigger back towards the rear hand grip by pressing the trigger with a finger by said user.

In a preferred embodiment of the present invention, a method of using the rail balloon gun comprises the steps of pulling the neck of a non-inflated balloon over the front end of the rail barrel axially by keeping the trigger in pulled condition, taking the neck of the non-inflated balloon through under the upper half and the lower half of the balloon clasping mechanism, releasing the trigger such that the upper half and the lower half of the balloon clasping mechanism hold the neck of the non-inflated balloon tightly over the front end of the rail barrel, blowing a fluid through the longitudinal bore to inflate the non-inflated balloon and pulling the trigger to release the balloon which propels out of the front end of said rail barrel due to force of the fluid getting discharged from the balloon.

Although few exemplary balloon attaching mechanisms are discussed herein, it should be obvious to those skilled in the art that many other forms of balloon attaching mechanisms can be used for the present invention.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the devices, methods and steps described in the specification. As one of ordinary skill in the art will readily appreciate from the disclosed embodiments, devices, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A balloon gun comprising:

a hollow cylindrical body having a front end and a rear end, said hollow cylindrical body having a hatch and a hatch cover disposed in said front end to facilitate insertion of a neck of an inflated balloon into said hollow cylindrical body from said front end;

one or more hand grips attached to said hollow cylindrical body;

a base disposed inside said hollow cylindrical body at a position accessible by a hand of a user through said hatch, said base comprising a slot having a raised top edge;

a balloon attaching mechanism positioned in said slot, said balloon attaching mechanism comprising a lower clip having a plurality of lower clip arms, an upper clip capable of sealing said neck of said inflated balloon and having a plurality of upper clip arms configured to get detachably engaged with said plurality of lower clip arms when said upper clip holding said neck of said inflated balloon is pressed into said lower clip by said user, and a spring placed below said lower clip in said slot; and a trigger pivotally mounted on one of said one or more hand grips or on said hollow cylindrical body with one end of said trigger connected to said lower clip through a cord or through a linkage, said trigger configured to exert a pull through said cord or through said linkage on said lower clip to pull said upper clip detachably engaged with said lower clip down along with said lower clip against said spring when said trigger is pressed by said user, wherein, when said plurality of upper clip arms of said upper clip detachably engaged with said lower clip come in contact with said raised top edge due to said pull, said plurality of upper clip arms get pressed outward resulting in dislodging of said upper clip from said lower clip and release of said neck of said inflated balloon from said balloon attaching mechanism;

wherein, a difference in fluid pressure that exists between inside and outside of said inflated balloon caused by elasticity of said inflated balloon makes a fluid used for inflating said inflated balloon rush out of said inflated balloon when said neck of said inflated balloon gets released and a resulting force pushes said inflated balloon forward to launch said inflated balloon from said balloon gun.

2. The balloon gun as in claim 1, wherein an inner surface of said hollow cylindrical body towards said front end is rifled.

3. The balloon gun as in claim 1, wherein an inner surface of said hollow cylindrical body towards said front end is smooth.

4. The balloon gun as in claim 1, wherein said upper clip is a disposable clip detachably attached to said neck of said inflated balloon prior to inserting said inflated balloon into said balloon gun.

5. The balloon gun as in claim 1, wherein said upper clip is a reusable clip detachably attached to said neck of said inflated balloon prior to inserting said inflated balloon into said balloon gun.

6. The balloon gun as in claim 1, wherein said base is mounted slidably on a rail inside said hollow cylindrical body to enable said user to adjust said position of said base as per preference of a desired trajectory of said inflated balloon being launched.

* * * * *